United States Patent [19]

Breen

[11] Patent Number: 4,630,384

[45] Date of Patent: Dec. 23, 1986

[54] SELF-LOCKING BAGGAGE TAG

[75] Inventor: Thomas J. Breen, Arlington Heights, Ill.

[73] Assignee: Rand McNally & Co., Skokie, Ill.

[21] Appl. No.: 697,033

[22] Filed: Jan. 31, 1985

[51] Int. Cl.[4] ..... G09F 3/14

[52] U.S. Cl. ..... 40/21 R; 40/2 R; 24/16 PB

[58] Field of Search ..... 40/304, 2 R, 21 R, 10 R; 24/16 R, 16 PB, 17 A, 17 B, 17 AP, 30.5 P

[56] References Cited

U.S. PATENT DOCUMENTS

| | | | |
|---|---|---|---|
| 627,920 | 6/1899 | Gould | 40/21 R |
| 945,854 | 1/1910 | Murray | 40/21 R |
| 1,001,209 | 8/1911 | Miller | 40/21 R |
| 1,324,568 | 12/1919 | Shelton | 40/21 R |
| 1,810,027 | 6/1931 | Moran et al. | 40/21 R |
| 1,824,199 | 9/1931 | Donohoe | 40/21 R |
| 1,984,589 | 12/1934 | Ludy | 40/21 R |
| 2,063,553 | 12/1936 | Mooney | 40/21 R |
| 2,098,164 | 11/1937 | Rice | 40/21 R |
| 2,468,397 | 4/1949 | Goldstein | 40/21 R |
| 2,554,105 | 5/1951 | Heinle | 40/21 R |
| 2,961,785 | 11/1960 | Toepfer | 40/21 R |
| 3,228,129 | 1/1966 | Gwinn et al. | 40/21 R |
| 3,231,992 | 2/1966 | Swett | 40/21 R |
| 3,837,101 | 9/1974 | Young | 40/21 R |
| 4,142,310 | 3/1979 | Groselak et al. | 40/21 R |
| 4,152,475 | 5/1979 | Haley | 24/16 PB |
| 4,447,934 | 5/1984 | Anscher | 24/16 PB |
| 4,466,159 | 8/1984 | Burrage | 24/16 PB |
| 4,510,649 | 4/1985 | Yudis et al. | 24/16 PB |

FOREIGN PATENT DOCUMENTS

| | | | |
|---|---|---|---|
| 1435102 | 3/1966 | France | 24/16 PB |

*Primary Examiner*—Gene Mancene
*Assistant Examiner*—J. Hakomaki
*Attorney, Agent, or Firm*—Dressler, Goldsmith, Shore, Sutker & Milnamow

[57] ABSTRACT

A disposable self-locking baggage tag made of sufficiently stiff and relatively tear-resistant conventional reinforced kraft paper tape. The tag comprises a rectangular strip having a slit formed therein adjacent one end. Locking means carried by the strip are provided in the form of a locking tab which cooperates with the slit to form a closed loop, or in the form of rows of opposed angled cuts formed in the lateral edges of the strip and adapted to cooperate with the slit to lock the tag into a closed loop of selected size.

12 Claims, 9 Drawing Figures

FIG. 1
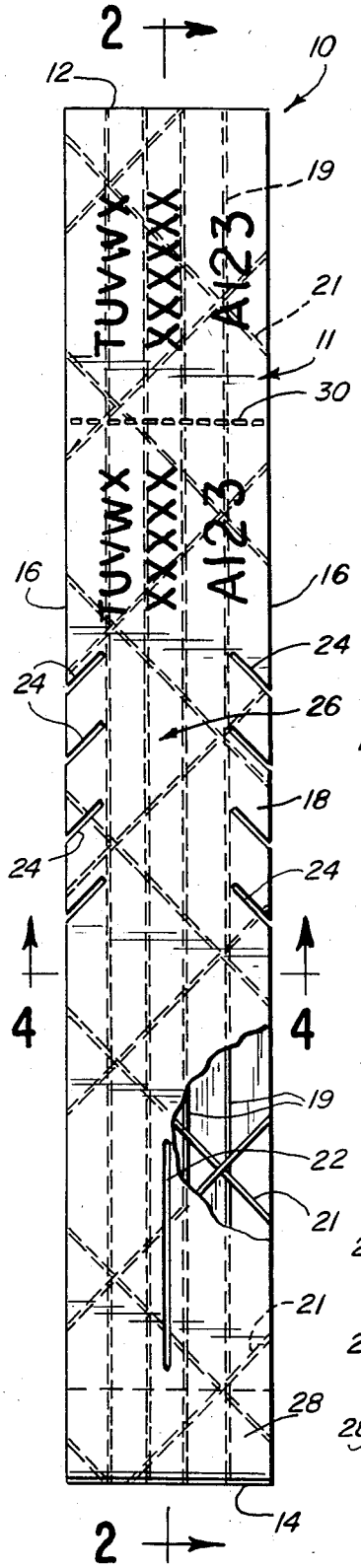
FIG. 2
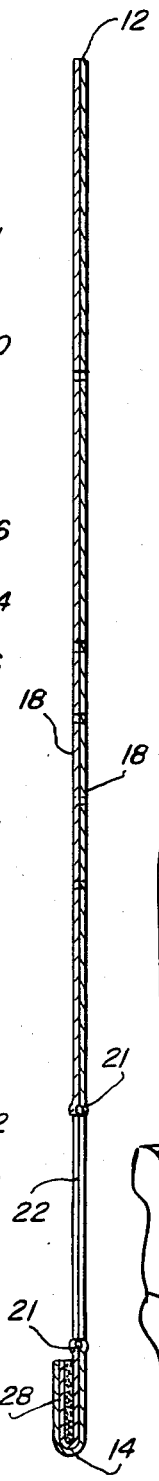
FIG. 5
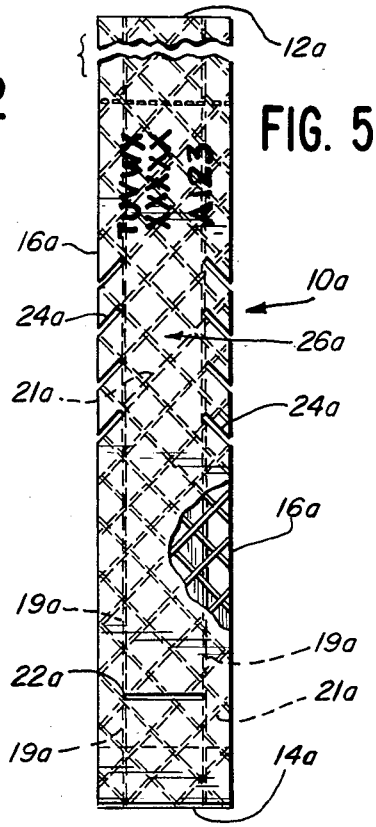
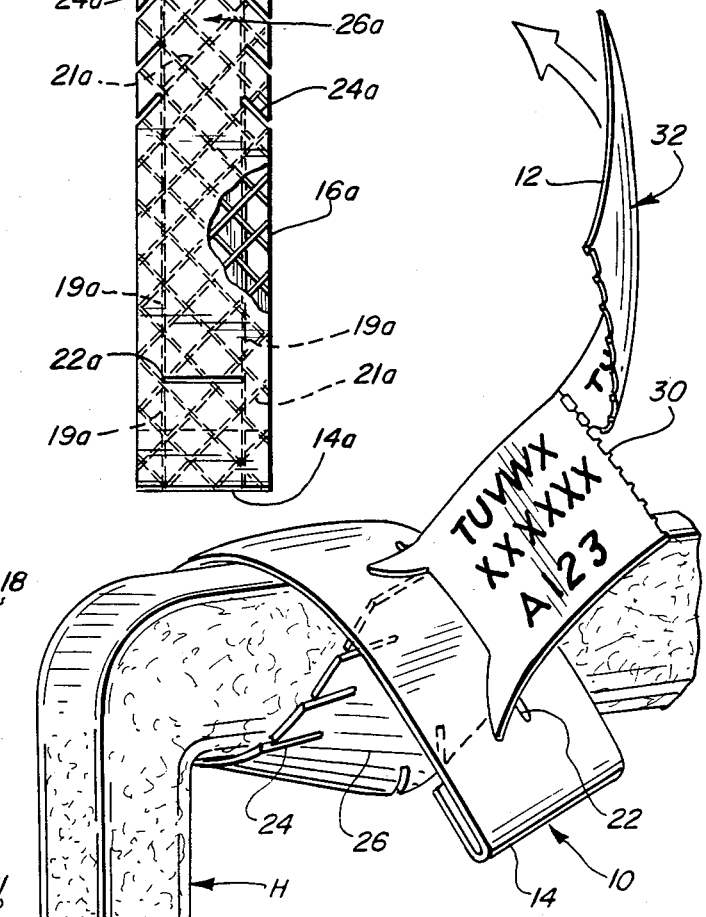
FIG. 3
FIG. 4
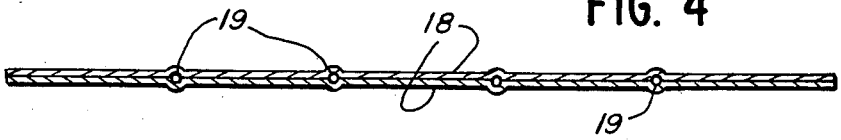

SELF-LOCKING BAGGAGE TAG

BACKGROUND OF THE INVENTION

This invention relates to disposable identification tags for temporary attachment to pieces of baggage and, more particularly, to a paper product baggage tag having integral self-locking means.

Disposable baggage tags have become virtually indispensable in a world of constantly expanding travel and commerce. Such baggage tags provide essential identification of destination and customer at airports, railroad stations, freight handling terminals, and the like, and countless numbers of them are used daily. Owing to their widespread use and temporary character, the cost of such baggage tags becomes a significant factor in their acceptability. Other important considerations are their ease of attachment and resistance to tearing and inadvertent removal during the coarse handling to which the tagged articles are frequently subjected.

In general, a baggage tag of the type under consideration comprises an elongated, slender, rectangular strip of flexible material made of a paper product or an equivalent synthetic substitute. The tag usually includes a claim check portion to be removed and given to the customer and means for attaching the tag to the article to be identified.

One form of prior art baggage tag comprises a strip made of a relatively heavy card stock paper. The card stock paper strip is provided with an eyelet at one end and a string or elastic loop is connected through the eyelet permitting attachment to the baggage handle with a form of loop or hitch connection.

In other forms of prior art baggage tags, the strip comprises a laminate of paper and polyester film construction or a sheet of spun polyester filaments of the type commonly used in well-known non-tear envelopes. In each of those prior art constructions, the inner face of the strip is usually partially or completely coated with an adhesive or cohesive glue. In order to attach those tags, the strip is passed through the baggage handle and the two ends adhered together, usually after removal of a protective liner, to form a closed loop. The primary drawback of such prior art tags is the relatively high cost resulting from the material of construction, the application of adhesives and/or the assembly of individual parts.

Still another form of prior art identification tag comprises a strip of substantially ordinary paper having a longitudinal slit adjacent one end thereof. The paper strip is attached to the article handle by simply passing one end thereof through the slit to form a rather loosely connected loop. That tag is suitable only for safe applications, such as customer hand-carried luggage or coat check rooms, because it is unable to withstand the rough treatment encountered when the baggage is handled by the carrier or others. A tag of that type which is specifically configured in an effort to avoid certain of the typically encountered problems is illustrated in U.S. Pat. No. 3,231,992.

There thus exists a need for a baggage tag which is simple to attach and capable of withstanding tearing or loss because of rough handling. At the same time, the baggage tag should be less expensive to manufacture than conventional prior art baggage tags.

SUMMARY OF THE INVENTION

The present invention provides an efficient and inexpensive baggage tag which overcomes or alleviates the problems alluded to.

The inventive baggage tag makes use of a common, inexpensive material of construction, namely, reinforced tape which comprises two layers of Kraft or other paper laminated around a grid of nylon, glass or other fibers. The reinforced tape is highly tear resistant but nonetheless has sufficient rigidity to function efficiently for the intended purposes of the invention.

There is no adhesive whatever needed in the tag of the present invention for purposes of attachment to an article. Instead, the tag carries its own mechanical locking means. More particularly, the strip of reinforced tape is provided with a slit adjacent one end thereof. Locking means carried by the strip are provided intermediate the ends of the tape, such as a locking tab mounted on the strip or a series of short diagonal cuts formed in the strip along the lateral edges thereof and spaced from the slit. To attach the tag, the free end of the strip is passed through the slit and drawn as tight as desired to a location corresponding to that of the locking means. When the threaded portion is now pulled back slightly, the locking means locks with the edge or edges of the slit to securely lock the tag to the article.

Other objects, features and advantages of the invention will be apparent from the following description and are illustrated in the accompanying drawings which show structure embodying the preferred features of the present invention and the principles thereof.

BRIEF DESCRIPTION OF THE DRAWINGS

FIG. 1 is a plan view of a baggage tag embodying the principles of the invention;

FIG. 2 is a sectional view taken substantially along line 2—2 of FIG. 1;

FIG. 3 is a perspective view showing the tag of FIG. 1 in locked condition as attached to a baggage handle or the like;

FIG. 4 is an enlarged sectional view taken substantially along line 4—4 of FIG. 1;

FIG. 5 is a plan view of a modified form of the baggage tag;

DETAILED DESCRIPTION OF THE INVENTION

Figure 6:
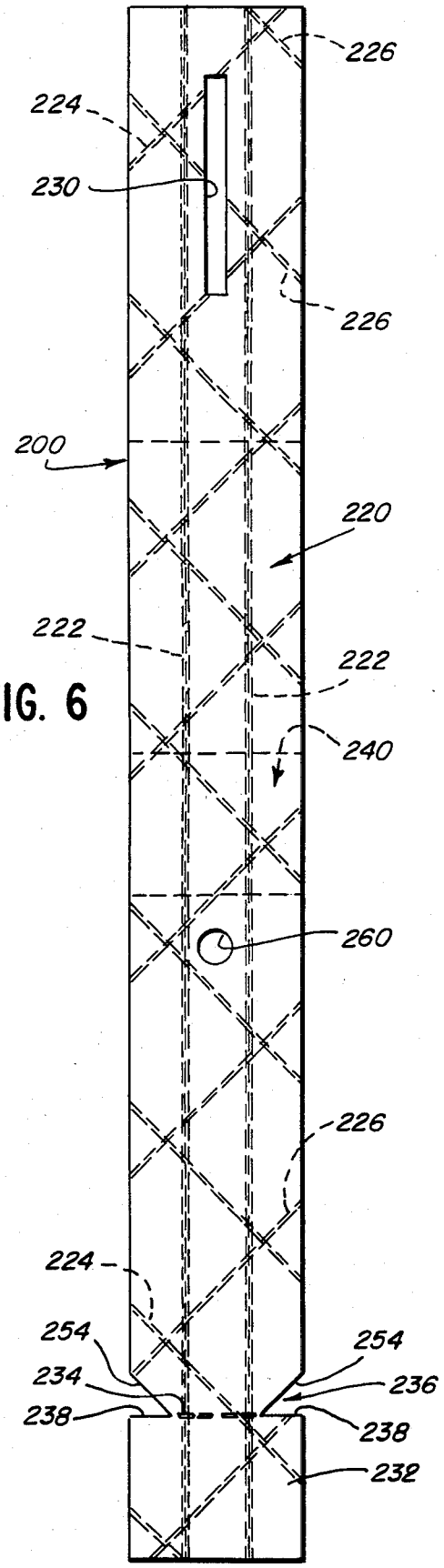
FIG. 6 is a plan view of a further modified form of a baggage tag of this invention.

Referring now with greater particularity to the various figures of the drawings, it will be seen that the reference character 10 indicates generally a baggage tag embodying the principles of the invention. The tag 10 comprises an elongated generally rectangular strip 11 having end edges 12 and 14 and side edges 16, 16.

The strip 11 is a paper product strip and comprises a pair of layers of paper 18, 18, preferably Kraft paper, laminated together with a grid of fibers 19, 21 made of nylon, glass, or the like, disposed therebetween in a suitable pattern. A common or commercially available construction is known as diamond pattern wherein the grid has longitudinal fibers 19 and diagonal fibers 21. Those skilled in the art will recognize this material of construction as typical reinforced wrapping tape, it being noted, however, that the customary coating of glue may be absent. It has been discovered that this well-known and inexpensive material of construction has the required degree of stiffness and yet is relatively tear resistant and sufficiently flexible to be suitable for use as a baggage tag.

A locking slit 22 is formed in the strip 11 and extends longitudinally from a point adjacent the end edge 14 of the strip. Opposed pairs of diagonal locking cuts 24 longitudinally spaced from the slit 22 are formed in the portion of the strip 11 intermediate its ends and along the side edges 16 of said strip. The cuts 24 angle outwardly toward the respective lateral edges 16 of the strip 11, and open at the lateral edges 16. The inclination or angle of intersection of the cuts with the lateral edges is in the direction of the end 14 bearing slit 22. The cuts also define an uncut field 26 in strip 11 between the opposed rows of locking cuts 24.

To insure against tearing of the slit 22 through the end edge 14, edge 14 may be reinforced by a short, folded-over segment 28 adhered to the inner face 18 of the strip. Additionally, the slit 22 preferably is positioned between reinforcing fibers 19 as illustrated in FIG. 1. A transverse score or perforation line such as line 30 is formed in the strip 11 adjacent the edge 12 of said strip to define a removable segment 32 which can be readily detached to provide a claim check for the customer.

In operation, the strip 11 is placed through the handle H of the article to be tagged and the end edge 12 is looped toward the end edge 14 and threaded through the slit 22. The loop thereby formed may be drawn as tight as desired corresponding to a pair of opposed locking cuts 24. With a slight reverse movement of the threaded portion of the strip 11, the selected pair of cuts 24 will now engage the slit 22 to securely lock the tag 10 to the article, generally as shown in FIG. 3. The segment 32 may now be detached and handed to the customer. If desired, this claim tag segment may be detached first before the described attaching operation.

It is not necessary that the length of the slit 22 be maintained to any precise tolerances, the slit in the embodiment illustrated being slightly longer than the width of the strip 11 for ease of insertion of end 12 through the slit. On the other hand, secure locking action may also be achieved if the length of the slit 22 is substantially equal to, or only slightly longer than, the width of the field 26 between the rows of cuts 24.

In FIG. 5 there is illustrated a modified form of the tag 10 wherein like parts bear like reference numbers with the suffix "a" added. In tag **10*a*, the locking slit 22*a* is also formed in the strip 11*a* adjacent the end edge 14*a* of the strip. Here, however, the slit 22*a* extends transversely or perpendicular to the side edges 16*a* of the strip. Preferably, the end edges of the slit 22*a* are defined by a pair of longitudinal reinforcing fibers 19*a* and diagonal fibers 21*a* to resist tearing. Operation of tag 10*a* is substantially the same except that threading of the end edge 12*a* through the slit 22*a* requires a slight pinching or bending of the strip 11*a* to permit passage through the shorter slit 22*a*. Slit 22*a* is, however, substantially equal in length, or slightly longer than, the width of the field 26*a*** so that efficient self-locking cooperation results.

Referring now to FIGS. 6 to 9, a further embodiment of a baggage tag of the present invention is illustrated. Baggage tag 200 comprises a paper product strip as of a kraft paper tape which is commercially known as fiberglass in machine direction with superimposed diamond pattern. The strip 220 is about 1¼ inches wide and has parallel rows 222, 222 of double-stranded reinforcing fibers in the longitudinal direction. Two, three, or more strands of fibers can be used if desired. The fibers 222 are preferably spaced apart about ½ inch, although, if desired, they could be closer together. The strip 220, like that of the other embodiments, comprises two layers of kraft paper between which the reinforcing fibers are embedded. The diamond pattern comprises transverse fibers 224, 226 at angles of about 45 degrees to the machine or longitudinal direction, and at about 90 degrees to each other. The angle of the transverse fibers may range from about 20 degrees to about 45 degrees to a line normal to the longitudinal direction of the longitudinal fibers. Fibers 224, 226 may be single strands of fibers, or, if desired, may be multiple strands.

At one end of the strip 220, a separate piece 227 of the same tape is adhered thereto to provide a reinforced double thickness section or reinforced strip segment 228. The piece 227 is approximately 3 inches long and it is important to note that the reinforcing fiber pattern therein is directed normally to that of the strip 220, viz., the fiber rows 222 project laterally rather than longitudinally. The section 228 thus provides a strongly reinforced construction capable of resisting all normal tearing forces. A longitudinal slot 230 approximately 1½ inches long is provided in the strip section 228. Slot 230 is disposed between the spaced double fibers 222.

The remote end of the strip 220 is provided with a removable segment 232 which is adapted to serve as a claim check. Segment 232 is about 1½ inches long and is defined, at one end, by a transverse line of perforations 234 terminating laterally at notches 236, notch edges 238 comprising a continuation of the transverse line 234. The line of perforations 234 should preferably sever at least the double fibers 222 to facilitate removal of the segment 232.

Figure 7:
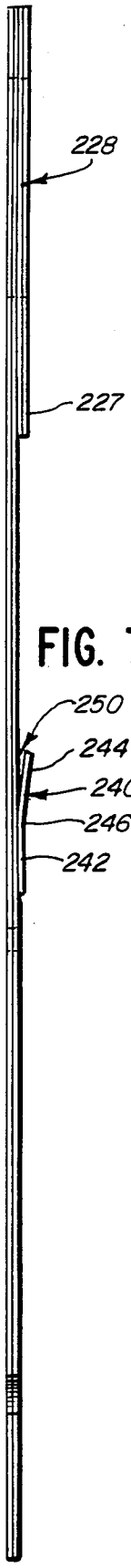
FIG. 7 is a side elevational view of the baggage tag of FIG. 6.
Figure 8:
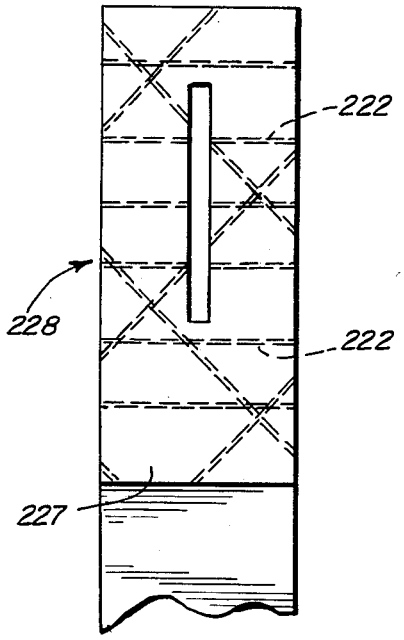
FIG. 8 is a partial rear elevational view of the baggage tag of FIG. 6.
Figure 9:
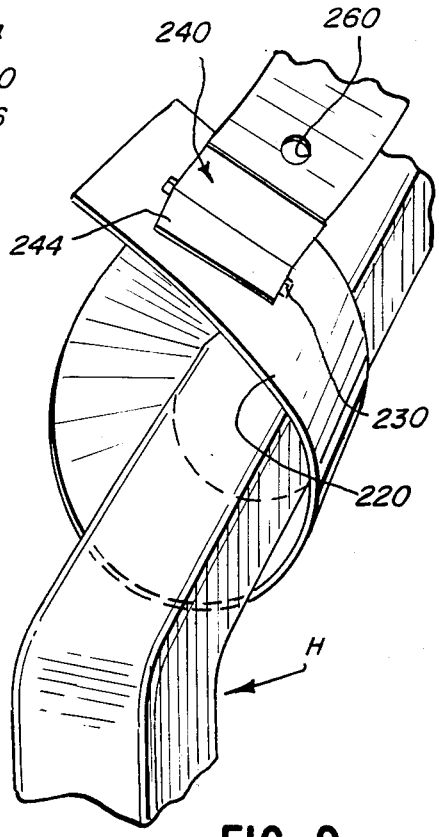
FIG. 9 is a perspective view showing the tag of FIG. 6 attached to a baggage handle.

To provide for the locking of the tag to the handle or the like of luggage, the rear of the strip 220 mounts a locking tab 240 intermediate the ends of the strip. Locking tab 240 is formed of a typical card stock material which is adhered to the strip 220 for a portion 242 of the length of the tab 240 either by adhesive on the strip or by separately applied adhesive. The adhered portion 242 of the tab terminates in a free or flap segment 244 which may desirably be provided with a crease line 246 to facilitate outward bending of the flap segment, as is illustrated in FIG. 7.

When the baggage tag 200 is to be used, the free end remote from the slot 230, with or without the claim check segment 232, is threaded through the slot until the locking tab 240 passes entirely through the slot. At that time, the flap segment 244 is opened (if not already open) to the position of FIG. 7, and the tab is then pulled rearwardly to cause the V-notch 250 defined by the flap segment 244 and the strip to receive the edge of the strip 220 adjacent the slot 230, thus locking the tag into a loop. At that time, if it has not already been removed, the claim check segment 232 is removed. It will be apparent that if the segment 232 was previously removed, the tapered edges 254 of the strip provided by notches 236 will assist in threading the end of the strip through the slot 230.

Where desired, a perforation 260 or zone of weakness may be provided in the strip at a location beyond the locking tab 240. This is provided as a safety feature to promote preferential tearing of the strip thereat, rather than to tear at the locking connection in the event that excessive longitudinal forces are applied to the free end of the strip after the tag is applied to luggage and locked into a loop.

Although typical brown kraft paper tapes may be used, bleached (white) kraft paper may be used as well, especially for the outer (non-adhesive) layer on which destination and other information may be imprinted. Other types of paper than kraft paper may also be used if desired.

It will be apparent that tags in accordance with the present invention do not depend upon cohesive or adhesive securance. Rather, they utilize mechanical means for providing a positive interlocked connection between the looped portions. Thus, the disadvantages inherent in the use of adhesives and cohesives are eliminated. For example, adhesives and cohesives tend to be temperature and humidity sensitive, so that their effectiveness varies on cold and hot days and with high humidity. Some, such as cohesives, tend to have shelf lives which decrease over time, particularly at high temperatures and high humidity. As a result, despite the presence of adhesives or cohesives, stapling or the like is sometimes used to supplement adherence. The mechanical interlock of the present invention eliminates these problems and disadvantages of adhesives and cohesives.

While preferred embodiments of the invention have been illustrated and described herein, it will be appreciated that changes and variations may be made by those skilled in the art without departing from the spirit and scope of the appended claims. The invention is defined by the claims that follow.

What is claimed is:

1. A disposable tag for attachment to an articles of baggage or the like comprising:

an elongated reinforced paper product tape strip having longitudinal reinforcing fibers therein;

a locking slit formed in said strip adjacent one end edge thereof; and locking means carried by said strip intermediate the ends thereof, said locking means comprising a locking tab mounted on one face of said strip, said locking tab comprising a separate thin paper product member which has a portion which is adhered to said strip and having a portion separated from, and unadhered to, said strip for engaging the strip adjacent said slit;

the other end edge of said strip being threadable through said slit to form a loop around a portion of an article, and said locking tab unadhered portion being engageable with the strip adjacent the slit to lock the loop closed and prevent inadvertent opening thereof.

2. A tag according to claim 1 wherein said locking slit extends longitudinally of the strip.

3. A tag according to claim 2 wherein said locking slit extends longitudinally of the strip and is longer than the width of said strip.

4. A baggage tag according to claim 1 and further comprising tear means formed in said strip adjacent said other end edge and extending transversely of the strip whereby a segment of the strip is readily removable therefrom.

5. A baggage tag according to claim 4 wherein said tear means comprises a line of perforations terminating laterally in notches whereby removal of said segment provides a tapered free end edge for said strip to facilitate threading thereof through said locking slit.

6. A baggage tag according to claim 4 and further comprising a transverse weakness zone in said strip between said locking tab and said other end edge of the strip.

7. A baggage tag according to claim 1 wherein said strip comprises a paper tape having a pair of longitudinal double strand reinforcing fibers, said locking slit being positioned between said pair of fibers, and said locking tab comprises a paper card stock member adhered in a portion thereof to the face of said tape.

8. A disposable tag for attachment to an article of baggage or the like comprising:

an elongated, reinforced paper product strip having longitudinal reinforcing fibers therein;

a double thickness of paper product strip adjacent one end thereof to provide a reinforced strip segment;

a longitudinally extending locking slit formed in said strip segment; and a locking tab mounted on one face of said strip intermediate the ends thereof and lying thereagainst, said locking tab comprising a separate thin paper product member which has a portion which is adhered to said strip and having a portion free of said strip for engaging the strip adjacent said slit;

the other end of said strip being threadable through said slit to form a loop around a portion of an article, and said locking tab unadhered portion being engageable with the strip adjacent the slit to lock the loop closed and prevent inadvertent opening thereof.

9. A tag according to claim 8 in which said reinforced paper product strip comprises a reinforcing fiber grid having fibers disposed longitudinally thereof and fibers disposed diagonally relative to said longitudinal fibers, said fibers being laminated between two layers of paper product, and in which said strip segment comprises a separate length of reinforced paper product strip adhered to said one face of said elongated strip; said separate length paper product strip comprising a reinforcing fiber grid having fibers disposed laterally to said longitudinal fibers and fibers diagonally disposed relative to said lateral fibers, said separate length fibers being laminated between two layers of paper product.

10. A tag according to claim 8 and further comprising tear means formed in said strip adjacent said other end and extending transversely of the strip whereby a segment of the strip is readily removable therefrom.

11. A tag according to claim 10 wherein said tear means comprises a line of perforations terminating laterally in notches whereby removal of said segment provides a tapered free end for said strip to facilitate threading thereof through said locking slit.

12. A tag according to claim 10 further comprising a transverse weakness zone in said strip between said locking tab and said other end edge of the strip.

* * * * *